US008875451B1

(12) United States Patent
Parduhn et al.

(10) Patent No.: US 8,875,451 B1
(45) Date of Patent: Nov. 4, 2014

(54) STACKABLE FOUNDATION ANCHORS

(75) Inventors: A. Philip Parduhn, Edmond, OK (US); Kevin S. Shook, Luther, OK (US)

(73) Assignee: Pelco Products, Inc., Edmond, OK (US)

( * ) Notice: Subject to any disclaimer, the term of this patent is extended or adjusted under 35 U.S.C. 154(b) by 756 days.

(21) Appl. No.: 11/669,276

(22) Filed: Jan. 31, 2007

(51) Int. Cl.
*E04H 12/22* (2006.01)

(52) U.S. Cl.
USPC ..... 52/165; 52/40; 52/157; 52/169.13

(58) Field of Classification Search
USPC ..... 52/155, 156, 157, 165, 40, 745.18, 263, 52/170, 169.9, 169.13, FOR. 118, 52/FOR. 119; 248/156, 530
See application file for complete search history.

(56) References Cited

U.S. PATENT DOCUMENTS

| | | | | | |
|---|---|---|---|---|---|
| 233,565 | A | * | 10/1880 | Shriver | 52/165 |
| 3,846,851 | A | | 11/1974 | Pepper | |
| 4,280,768 | A | | 7/1981 | Pardue, Jr. et al. | |
| 4,290,245 | A | * | 9/1981 | Pardue et al. | 52/157 |
| 4,310,090 | A | * | 1/1982 | Mackarvich | 206/443 |
| 4,596,334 | A | * | 6/1986 | Daulton | 211/64 |
| 4,626,330 | A | | 12/1986 | Farmer | |
| 4,742,656 | A | | 5/1988 | Farmer | |
| 4,979,341 | A | | 12/1990 | Norman et al. | |
| 5,199,836 | A | | 4/1993 | Gogarty | |
| 5,222,851 | A | | 6/1993 | Dickerson | |
| 5,570,577 | A | | 11/1996 | Dziedzic | |
| 5,653,069 | A | | 8/1997 | Dziedzic | |
| 5,904,009 | A | * | 5/1999 | Huang | 52/126.6 |
| 6,050,740 | A | | 4/2000 | Dziedzic | |
| 6,128,867 | A | * | 10/2000 | MacKarvich | 52/157 |
| 6,722,821 | B1 | * | 4/2004 | Perko et al. | 405/249 |
| 7,241,079 | B2 | * | 7/2007 | Francis | 405/231 |
| 2007/0120035 | A1 | * | 5/2007 | Albanese et al. | 248/530 |

OTHER PUBLICATIONS

Pelco Products Inc., Pelco Catalog pp. T10-7 (Aug. 25, 2005) and T10-8 (May 9, 2005) for "Mast Arms & Poles—Foundation Anchors" published 2005 by Pelco Products Inc. (Edmond, OK, USA) (2 pages).

Pelco Products Inc., Pelco Utility Bulletins U3-903 (Sep. 18, 2000) "Foundation Anchors" published 2005 by Pelco Products Inc. (Edmond, OK, USA) (2 pages).

* cited by examiner

*Primary Examiner* — Adriana Figueroa
(74) *Attorney, Agent, or Firm* — Mary M. Lee

(57) ABSTRACT

A screw-in foundation anchor for traffic, lighting and utility poles and the like. The anchor comprises a shaft with an upper end fixed to a base plate on which the pole base is attachable. A helical blade on the shaft allows the anchor to be driven into the earth by rotation. At least two notches are provided on the edges of the base plate, each notch sized to engage the shaft of an adjacent anchor. Multiple anchors can be strapped together in groups or bundles for storage and shipment, with the notches engaging adjacent anchor. Such an arrangement prevents dislodgement or shifting of the anchors in transit. This reduces the cost of shipping the anchors, decreases the likelihood of damage to the anchors during shipment, and improves the safety of handling the bundles and unloading the individual anchors.

32 Claims, 11 Drawing Sheets

STACKABLE FOUNDATION ANCHORS

FIELD OF THE INVENTION

The present invention relates generally to foundation anchors and more particularly, but without limitation, to screw-in foundation anchors for supporting traffic, lighting and utility poles.

BACKGROUND OF THE INVENTION

Foundation anchors are used to support various types of vertical poles, such as traffic, lighting and utility poles, along roadways and elsewhere. In most cases, and especially where new roadways are under construction, multiple poles and anchors are required. Typically, foundation anchors are stored and shipped in bundles or rows secured by various means. In most cases, spacers such as wood slats or polystyrene foam racks are used to support a number anchors in a row or in several tiers or layers that are strapped together into a shipping/storage unit. Some expense is involved in the production of the spacers, which are then simply discarded at the job site. In addition to the cost of the materials, significant labor is required to position the anchors on the spacers prior to securing them with the straps. During shipping, the spacers may become dislodged or shift out of proper alignment, allowing the anchors to become damaged as well as difficult and dangerous to handle or unload.

Thus, there is a need for a foundation anchor that can be bundled and shipped without spacers of any kind. Such an anchor will eliminate the cost of producing the spacers and the waste associated with their discard at the job site. In addition, anchors that can be bundled without using spacers will reduce the likelihood of damage to the anchors during shipment to the job site. Still further, there is a need for a more secure bundling system, which will in turn improve the safety associated with handling the bundles and unloading the individual anchors. These and other needs are satisfied by the foundation anchor of the present invention.

DETAILED DESCRIPTION OF THE PREFERRED EMBODIMENTS

Figure 1:
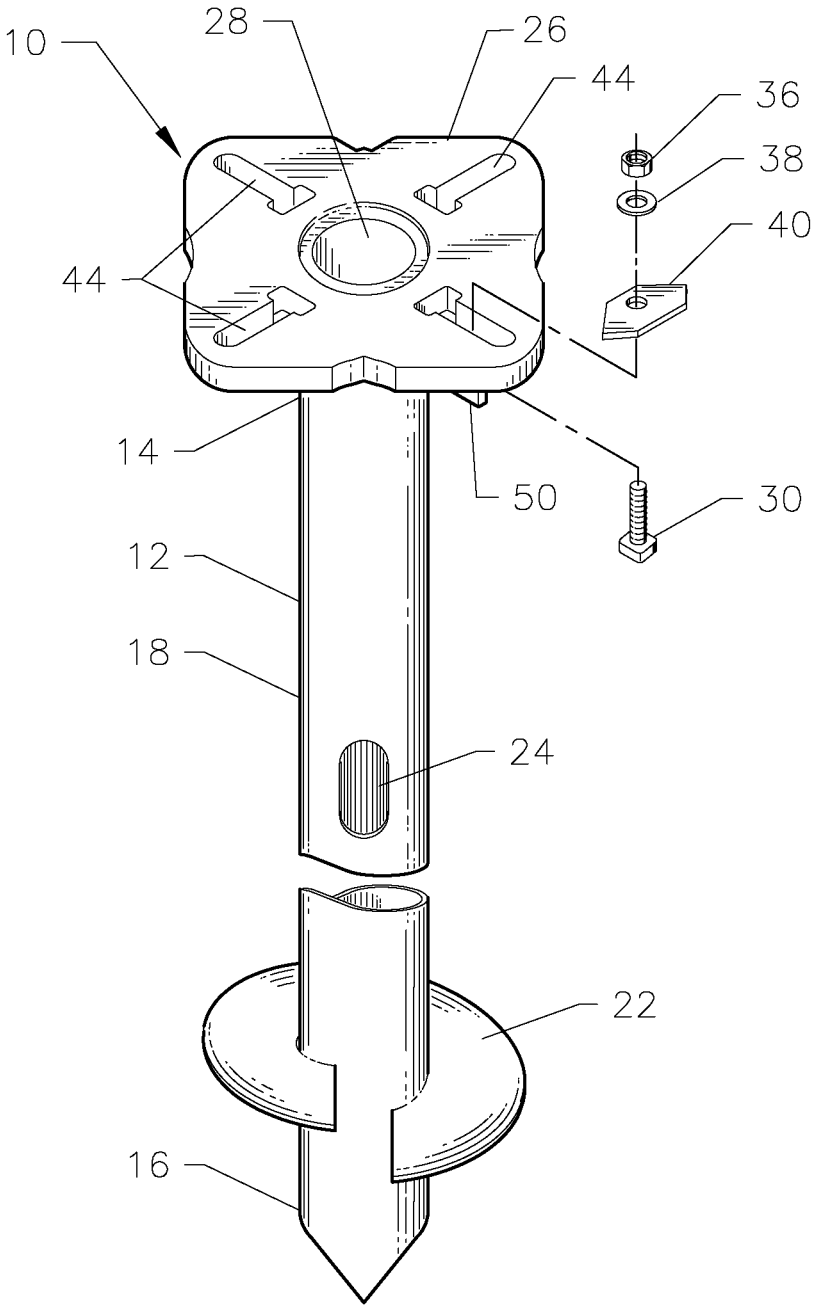
FIG. 1 is an exploded perspective view of an anchor constructed in accordance with the present invention.

Turning now to the drawings in general and to FIG. 1 in particular, there is shown therein an anchor constructed in accordance with the present invention and designated generally by the reference numeral 10. The anchor 10 is adapted for implantation into a compressible material, such as earth. To that end, the anchor 10 includes a shaft 12, preferably round in cross-section, and having a first or upper end 14, a second or lower end 16, and a body portion 18 therebetween.

To facilitate driving the shaft 12 into the earth, one or more blades may be provided on the shaft 12. In the embodiment shown herein, the blade comprises a helical blade 22 on the body portion 18 of the shaft 12 near the lower or second end 16. By means of the helical blade 22, the shaft 12 can be driven into the earth by a rotary motion using a hydraulic drill or some other suitable machine. Where the blade is positioned along the body of the shaft 12, the lower end 16 may be pointed or beveled as shown, or otherwise adapted to pierce the earth, to begin the driving process.

It will be appreciated, however, that the blade need not be helical in form; rather, linear splines could be used where the drive mechanism is a non-rotational impact or percussive system. Further, the position of the blade on the shaft may vary. For example, in some larger diameter anchors, it may be advantageous to place a helical blade at the bottom or lower end of the shaft and to include a pointed rod or "stinger" on the bottom of the blade to assist in the implantation of the anchor.

In most instances, the shaft 12 will be tubular having a hollow center. Typically, conduit openings 24 are provided on opposite sides of the shaft 12 for incoming and outgoing wiring, if any, that supplies the traffic signal or other device that will be supported on the pole for which the anchor 10 is being installed.

Figure 2:
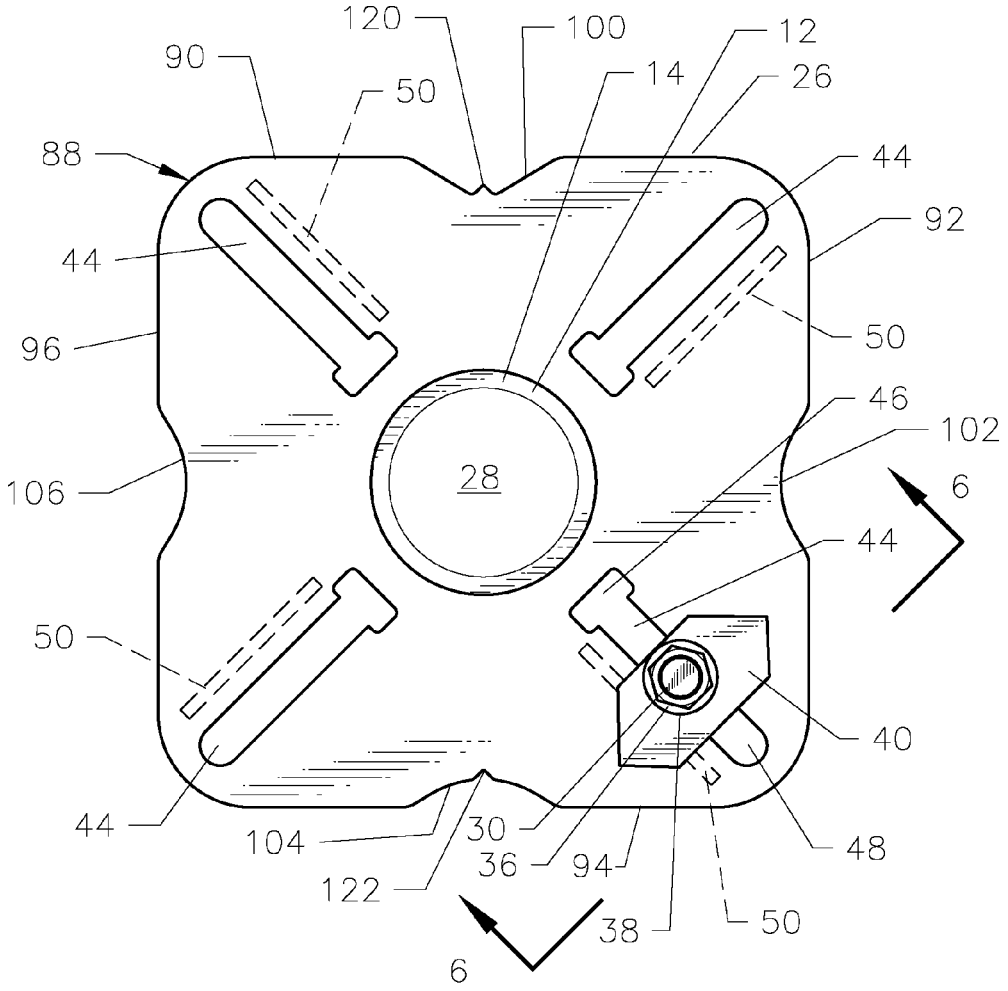
FIG. 2 is a plan view of the base plate of the anchor shown in FIG. 1 with one bolt assembly installed. The pole and pole base have been omitted to clarify the illustration.

Referring still to FIG. 1 and now also to FIG. 2, the anchor 10 comprises a base plate 26 fixed on the upper end 14 of the shaft 12. Preferably, the base plate 26 is square, but other shapes will work depending on the pole and pole base with which it will be used. A hole 28 is provided in the center of the base plate 26 for receiving the upper end 14 of the shaft 12. This joint may be welded or secured in any other suitable fashion.

Figure 3:
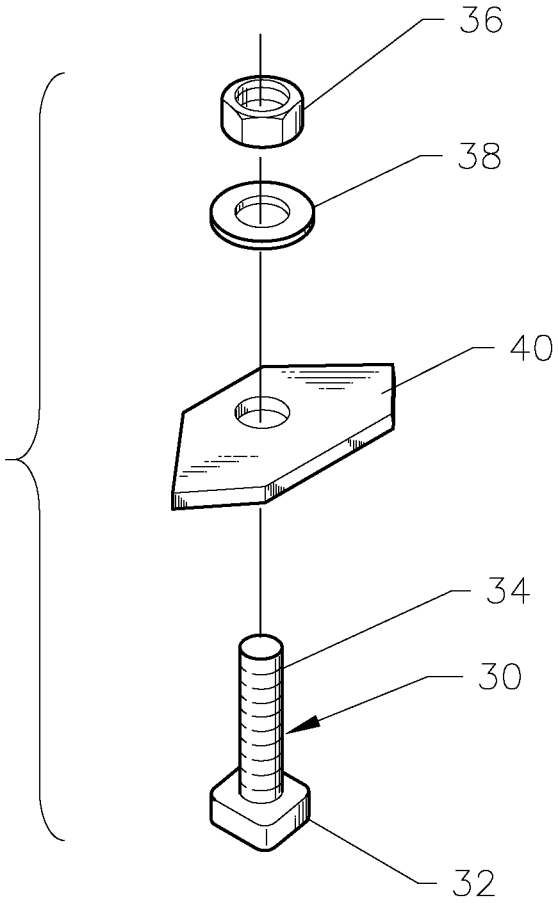
FIG. 3 is an exploded perspective view of the preferred nut and bolt assembly for attaching the pole base to the base plate of the anchor assembly.
Figures 4A, 4B, 4C:
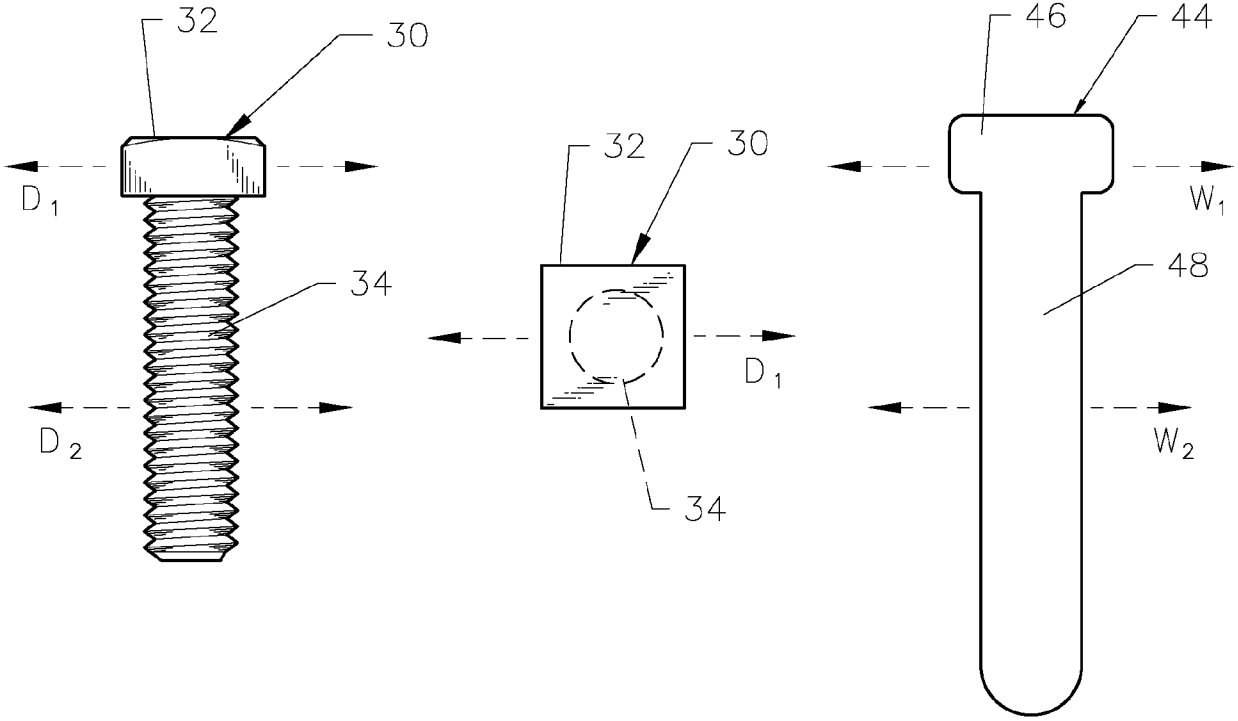
FIG. 4A shows a side elevational view of the bolt used in the preferred embodiment of the anchor of this invention.
FIG. 4B shows a plan view of the bolt in FIG. 4A.
FIG. 4C shows a plan view of the T-shaped slot in the preferred embodiment of the anchor of this invention.

With reference now to FIGS. 3, 4A, and 4B, the anchor 10 further comprises at least one and preferably four connectors, such as bolts 30, for connecting the base plate 26 to the pole base yet to be described. Each bolt 30 has a head 32 with a first dimension $D_1$ and a stem 34 with a dimension $D_2$, the head being wider than the stem in at least a first dimension and preferably centered on the stem. Preferably, the head 32 is square and the stem 34 is threaded for reasons that will become apparent. A nut 36 (FIG. 3) preferably is provided for each bolt 30, and the stem 34 of the bolt should be threaded to receive the nut. A washer 38 (FIG. 3) also may be included. Further, a corner member 40 may be included for a purpose described hereafter.

With continued reference to FIG. 2 and also now to FIG. 4C, the base plate 26 defines at least one and preferably four slots, designated generally by the reference numeral 44, there being one slot for engaging each bolt 30. More specifically, each slot 44 is sized to permit passage therethrough of the stem 34 of the bolt 30. Preferably, each slot 44 is sized to permit passage therethrough of the head 32 of the bolt 30 only when the first dimension $D_1$ of the head is aligned with the slot. More preferably, as seen best in FIGS. 2 and 4C, each slot 44 comprises a head portion 46 and a stem portion 48. The head portion 46, having a dimension $W_1$, is sized to allow passage therethrough of the head 32 of the bolt 30 when the edge of the head is aligned with the head portion of the slot 44.

The stem portion 48, having a width $W_2$, is sized to permit passage therethrough of the stem 34 of the bolt 30, but not the head 32. Preferably the slots 44 are T-shaped having the elongated head portion 46 at the end of and perpendicular to the narrower, elongated stem portion 48. More preferably, the slots 44, or the stem portions 48 of the slots, extend radially from the center of the base plate 26 in each corner thereof, with the head portion 46 between the center of the base plate and the stem portion 48.

Now it can be understood that the bolt 30 can be placed in the slot 44 by first aligning the head 32 (along dimension $D_1$) of the bolt with the head portion 46 ($W_1$) of the slot, and then inserting the head therethrough. Next, the head 32 is moved in the slot 44, along the length of the stem portion 48 of the slot, until the dimension $D_1$ is disaligned with the width $W_1$, and sliding the head along the stem portion 48 of the slot to the desired location. Thus, the head 32 of the bolt 30 can be placed under the base plate 26 by inserting the head through the slot from above the base plate when the base plate is about flush with the surface of the earth.

Now it will be apparent that access to the head 32 of the bolt 30, when positioned under the base plate 26 will be limited. Where a threaded nut and bolt assembly is used as the connector, it might be difficult to stabilize the bolt 30 against turning as the nut 36 is threaded on the stem 34.

Figure 6:
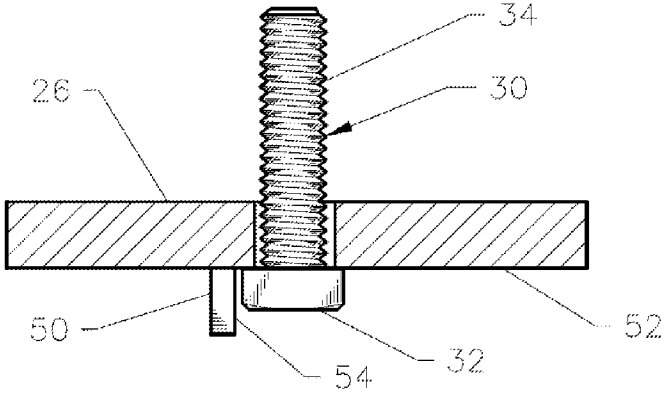
FIG. 6 is a cross-sectional view along line 6-6 in FIG. 2.
Figure 5:
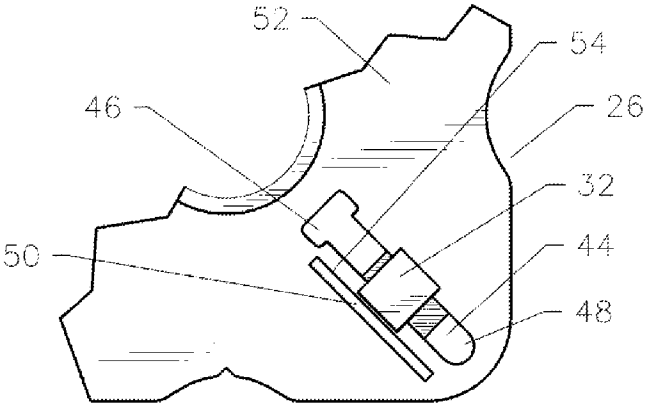
FIG. 5 is a bottom view of one corner of the base plate with the nut and bolt installed.

To alleviate this difficulty, the anchor 10 preferably is provided with an elongate member 50 extending from the bottom 52 of the base plate 26 parallel and adjacent to the stem portion 48 of each of the slots 44, as shown in FIGS. 5 and 6 to which attention now is directed. As described above, the head 32 of the bolt 30 preferably is square. However, the head 32 may be hexagonal as long as it is polygonal with at least one planar surface parallel to the longitudinal axis of the stem 34. The elongate member 50 preferably is a narrow bar with at least one planar abutment surface 54. In this way, as seen in FIG. 6, when the head 32 of the bolt 30 is pulled up snugly against the bottom 52 of the base plate 26 with the stem 34 of the bolt extending through the stem portion 48 of the slot 44, the planar side of the bolt head 32 will engage the abutment surface 54 non-rotatingly so that the nut 36 can be threadedly tightened on the stem 34. This engagement is released by simply unscrewing the nut until the head 34 of the bolt 30 can be pushed down beneath the elongate member 50.

In the preferred embodiment, where the shaft 12 is driven into the earth by rotation, the elongate members 50 will serve another function. The depending elongate members 50 will serve to excavate an area of soil as the bottom 52 of the base plate 26 scrapes the surface of the earth. Thus, each elongate member 50 may also function as a spacer to provide a space in the soil to receive the head 32 of the bolt 30 under the base plate 26 as the anchor is screwed into the earth. As a result, there is no need to dig into the soil while positioning the head 32 of the bolt 30. The length of the spacer, that is, the distance it extends down from the bottom 54 of the base plate 26 should be minimized to provide only enough space in the soil to accommodate the head 32 of the bolt 30. This will allow the head 32 of the bolt 30 to be supported by the soil underneath the base plate.

Where the shaft is driven into the earth by a direct impact or percussive system, without rotation, the space may include a surface extending under the slot so that there will be a space beneath the slot to receive the head of the bolt. For example, the spacer could take the form of a member that is L-shaped in cross-section, the vertical surface forming the abutment surface and the horizontal surface creating the cavity for the bolt head and for supporting the bolt in position in the slot.

Figure 7:
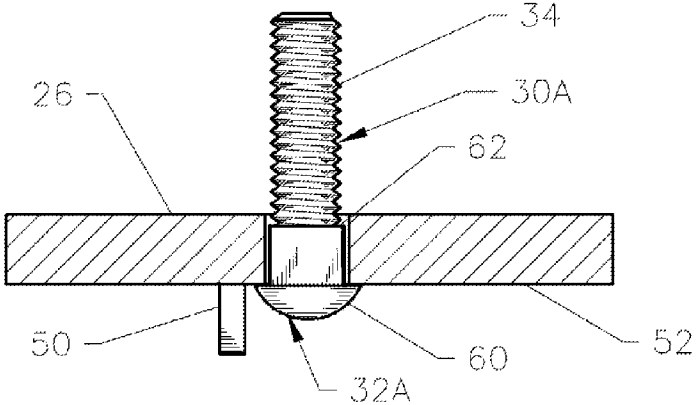
FIG. 7 is a cross-sectional view similar to FIG. 6 but showing the use of a carriage bolt instead of the square-headed bolt shown in FIG. 6.

While the preferred connector takes the form of a square headed bolt 30 with a threaded stem 32 and a nut 36 receivable thereon, other types of connectors may be successfully employed. For example, as shown in FIG. 7, the connector could a carriage bolt 30A wherein the head 32A comprises a cap 60 and a neck 62 between the cap and the stem 34. As in the conventional carriage bolt, the cap 60 has a greater diameter than the neck 62. Also, the cap 60 is round and domed and the neck 62 is square. However, the neck could have another shape comprising an equilateral polygon with at least two planar sides parallel to each other and to the longitudinal axis of the stem.

For use in this invention, though, the slot 44 should be sized so that one pair of parallel sides of the neck 62 of the bolt 30A can be non-rotatably received in stem portion 48 of the slot 44, as illustrated in FIG. 7. Thus, when the cap 60 of the bolt head 32A is beneath the base plate 26, the neck 62 is received in the slot 44, and the stem 34 extends above the base plate, then the nut can be tightened on the stem 34.

Figure 8C:
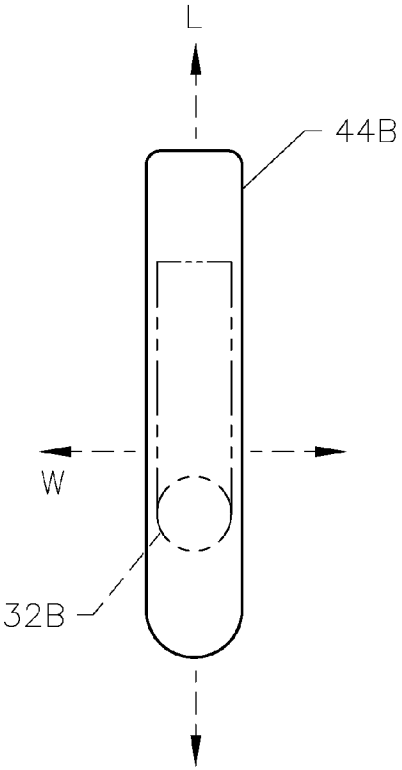
FIG. 8C shows a plan view of the slot for use with the L-bolt in FIGS. 8A and 8B.
Figure 8B:
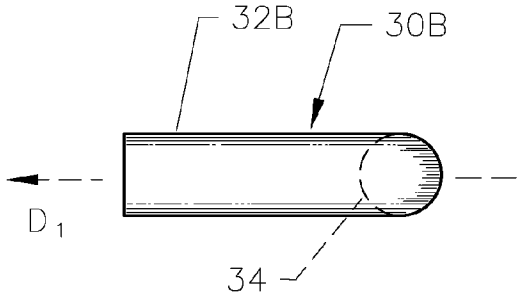
FIG. 8B shows a plan view of the bolt in FIG. 8A.
Figure 8A:
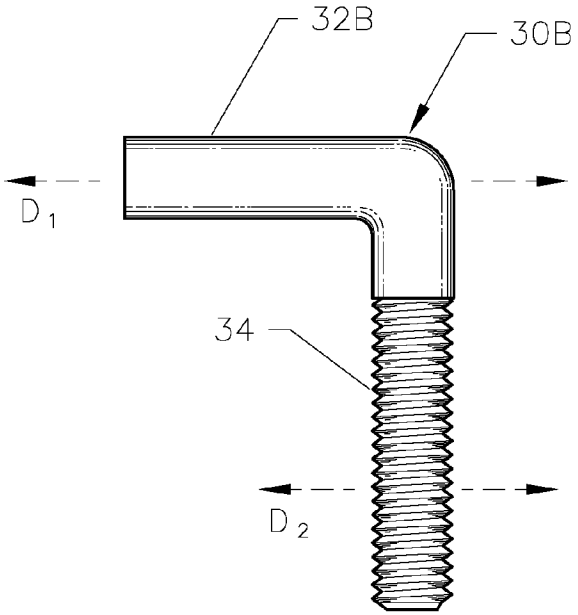
FIG. 8A shows a side elevational view of an L-bolt that can be used in another embodiment of the anchor of this invention.

In still another embodiment of the present invention, depicted in FIGS. 8A-C, the connector is an "L" bolt 30B where the head 32B is an elongated member extending to one side of the stem 34 creating a dimension $D_1$ which is greater than the dimension $D_2$ of the stem. As shown in FIG. 8C, this L-bolt 32B can be used with a slot 44B that has a uniform width W along its entire length L. That is, the head 32B is insertable through the slot 44A at any point if the head is aligned with the length L of the slot. Then, the stem 34 is rotated until the free end of the head 32B abuts the abutment surface 54 (not shown in FIG. 8C). It will be apparent that a T-bolt or J-bolt may also be substituted for the L-bolt and will function similarly.

It will be further appreciated further that a threaded connector is not essential. A non-threaded stem with a latch, bendable joint, clamp, set screw, or cross member could be used. An adjustable telescopic engagement could be utilized. Likewise, a toggle bolt configuration would be operable.

Having described the preferred anchor 10, its use now will be described. With reference again to FIG. 1, the shaft 12 and attached base plate 26 first are installed in the earth at the designated location. The shaft 12 is positioned into the earth so that the top of the base plate 26 is about flush with the surface of the earth. Although the shaft 12 can be placed in an open hole which is back filled, in most instances the placement of the shaft will be by a rotary mechanism of some sort utilizing the helical blade 22 on the shaft. In this case, the spacers/elongate members 50 will have formed a shallow cavity in the earth immediately beneath each slot 44. A bolt 30 is inserted into each slot and positioned in the desired location.

Figure 9:
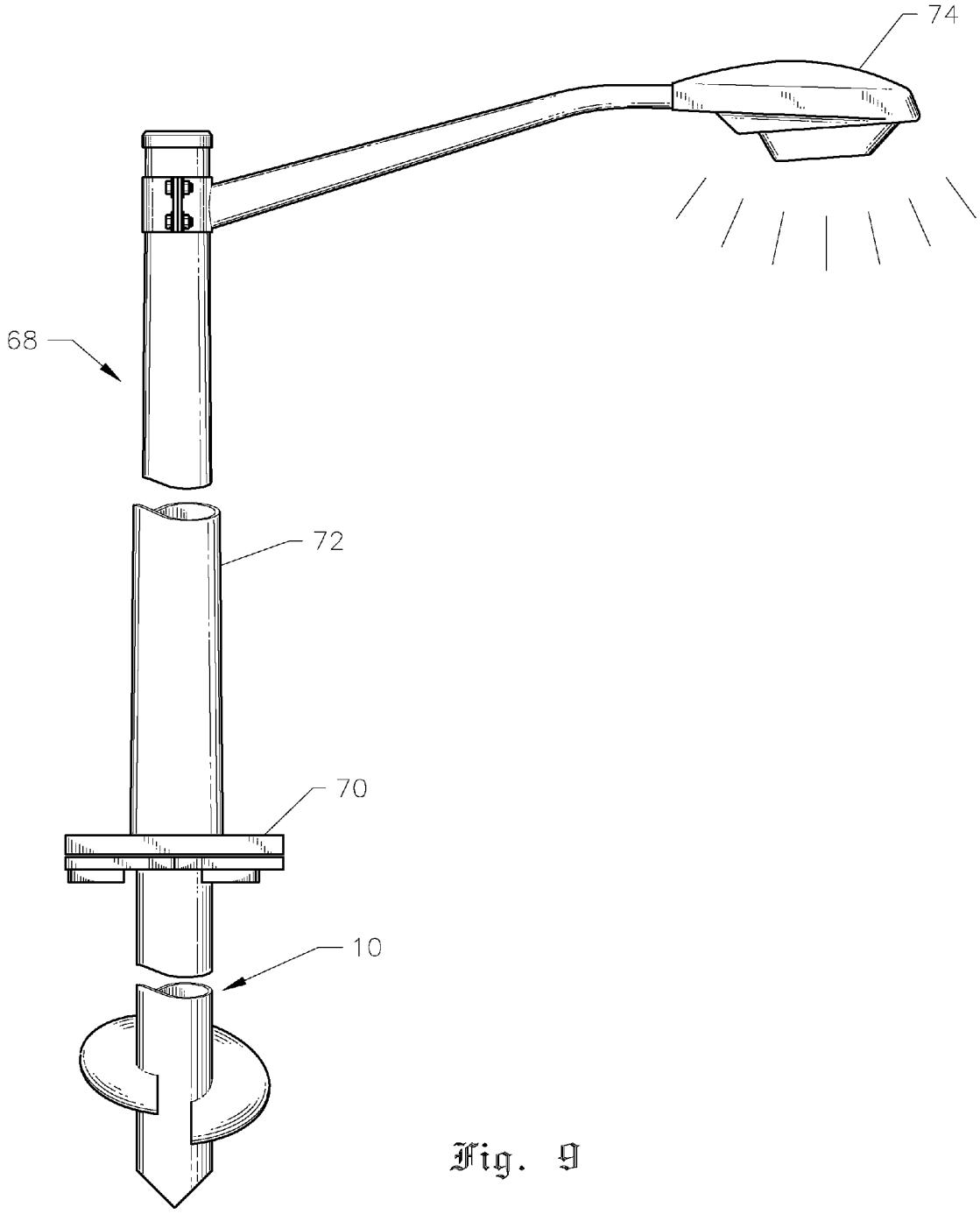
FIG. 9 is a perspective, partially cut away view of the pole assembly of this invention.

Turning now to FIG. 9, there is shown therein a pole assembly 68 in accordance with the present invention. The assembly 68 comprises a base 70, a pole 72 supportable by the base in a known manner, and the above-described anchor 10 supporting the base. In the example shown in FIG. 9, a streetlight 74 is shown extending laterally from the top of the pole 72. However, it will be apparent now that the term "pole" refers to any vertical support member that is supportable by means of an anchor assembly and includes, without limitation, poles that support any type of traffic control device, sign, lighting or electrical fixture.

Figure 10:
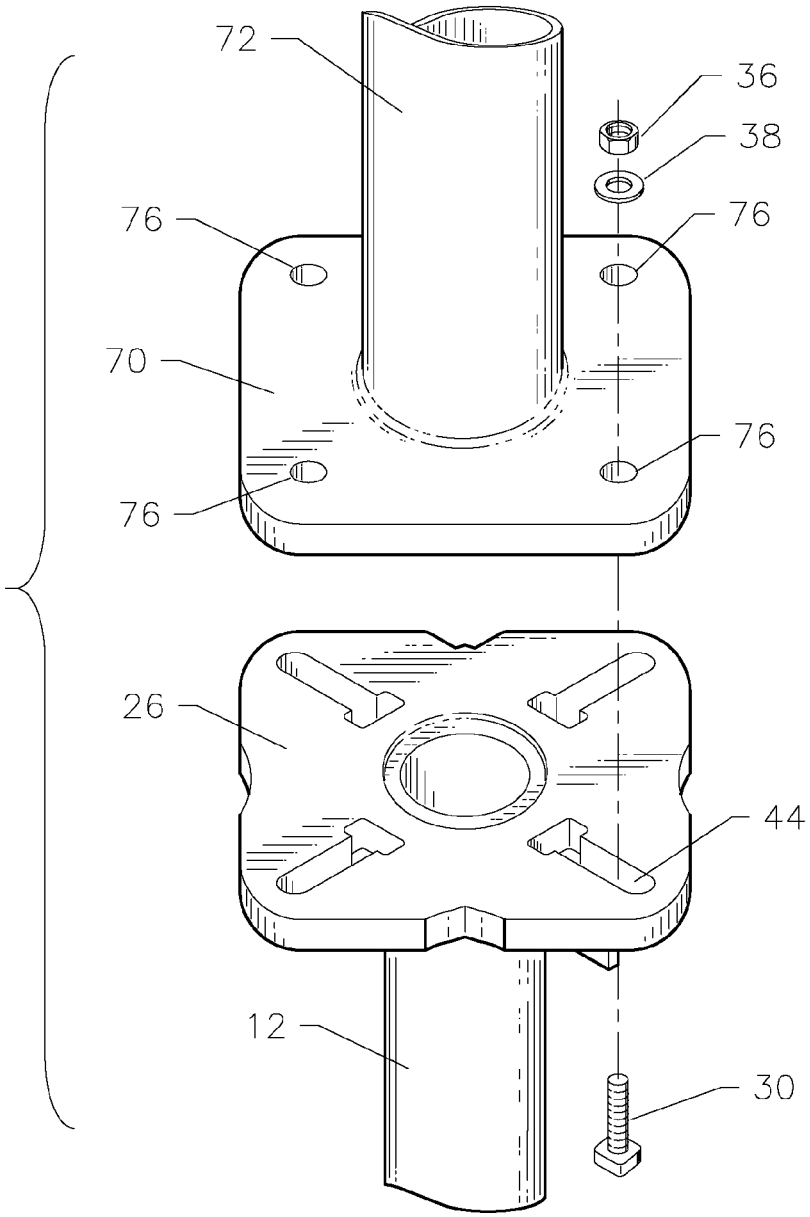
FIG. 10 shows a frontal perspective, partially cut away view of the base of a pole attached to the base plate of the anchor.

FIG. 10 shows how the pole base 70 is attached to the base plate 26 of the anchor 10. The base 70 typically is the same shape and size as the base plate 26 of the anchor 10, and is provided with a holes 76 in each corner aligned with the slots 44 in the base plate 26. Although not shown in this drawing, all four of the bolts 30 usually would be in position in the slots 44 at the time the pole base 70 is positioned over the anchor base 26. With the base 70 positioned over the base plate 26, the stems 34 of the bolts 30 are inserted in the holes 76 of the pole base. Then, washers 38 and nuts 36 are placed on the stems 34 and tightened until the pole base 70 is securely fixed to the anchor base 26. In the case of an ornamental street light, a decorative base enclosure can be placed around the base 70.

Figure 11:
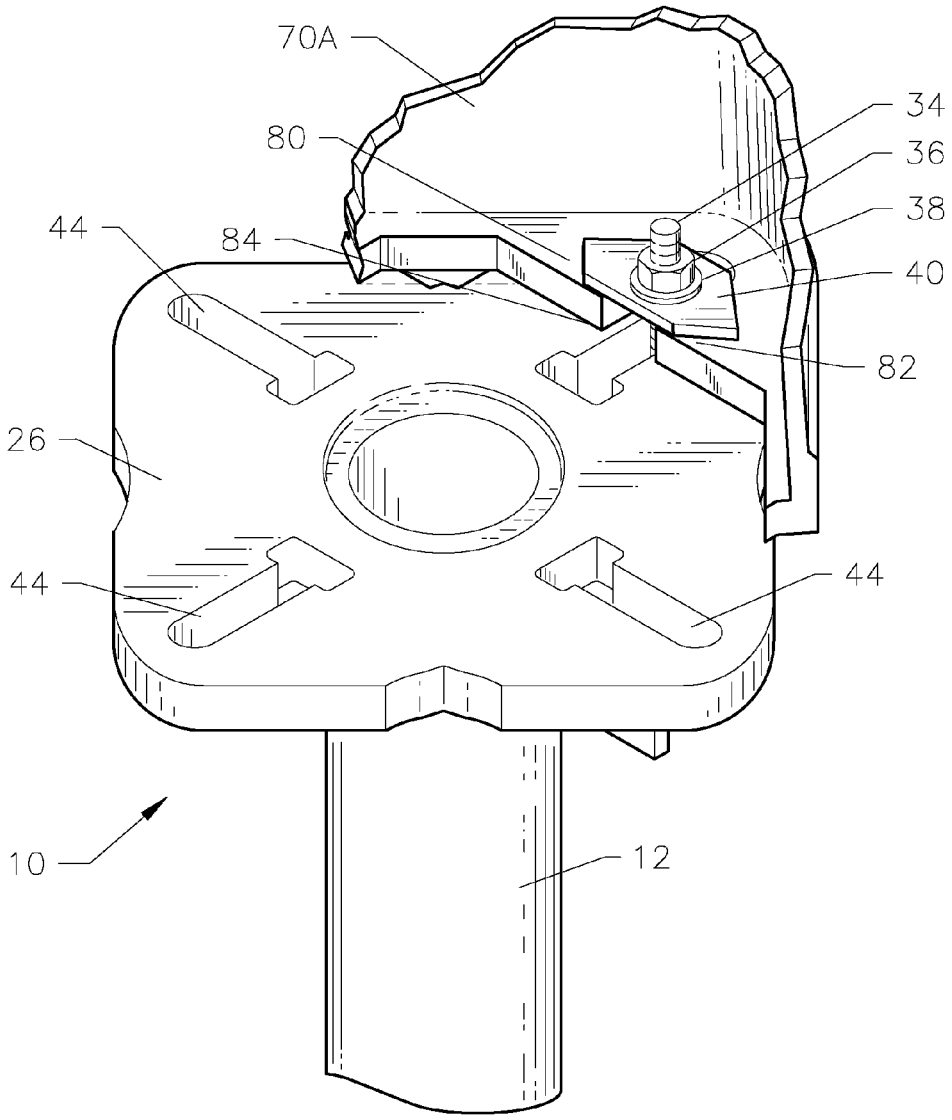
FIG. 11 shows a fragmented, perspective view of an inside corner of a transformer base connected to the base plate.

Turning now to the FIG. 11, the use of the anchor 10 with a transformer base will be described. The anchor 10 is driven in to the earth as described above, and the bolts 30 are positioned in the slots 44. Next, the transformer base 70A is moved into position over the base plate 26. As is well known, each inner corner of a transformer base is provided with a pair of ears 80 and 82 that form a notch 84 therebetween. Next, the corner member 40 (see FIG. 3) is positioned over the bolt 30 and across the ears 80 and 82 to span the notch 84. Then, the nut 36 and washer 38 are tightened down against the corner member 40. This is repeated in each corner of the base 70A. Finally, the pole 72 is secured to the base 70A in the conventional manner.

In the preferred embodiment of the present invention, the anchor 10 is adapted for convenient, spacer-free stacking with other like anchors to form a bundle of anchors for shipping and storage. To that end, the base plate 26 of each anchor 10 preferably is provided with a plurality of notches spaced equidistantly around its peripheral edge 88, as seen in FIG. 2. In the preferred embodiment where the base plate 26 is square with four sides, designated in FIG. 2 as 90, 92, 94 and 96, a notch may be positioned in center of each of the sides, such as the notches 100, 102, 104 and 106. It will be understood, however, that the stacking notches of the present invention can be adapted to base plates having other shapes, such as round, and that the base plates may have as few as two notches, depending on the number of anchors desired in a single bundle. Still further, while the notches 90, 92, 94 and 96 are shown as generally curved, they may take other forms such as V-shaped.

Figure 12:
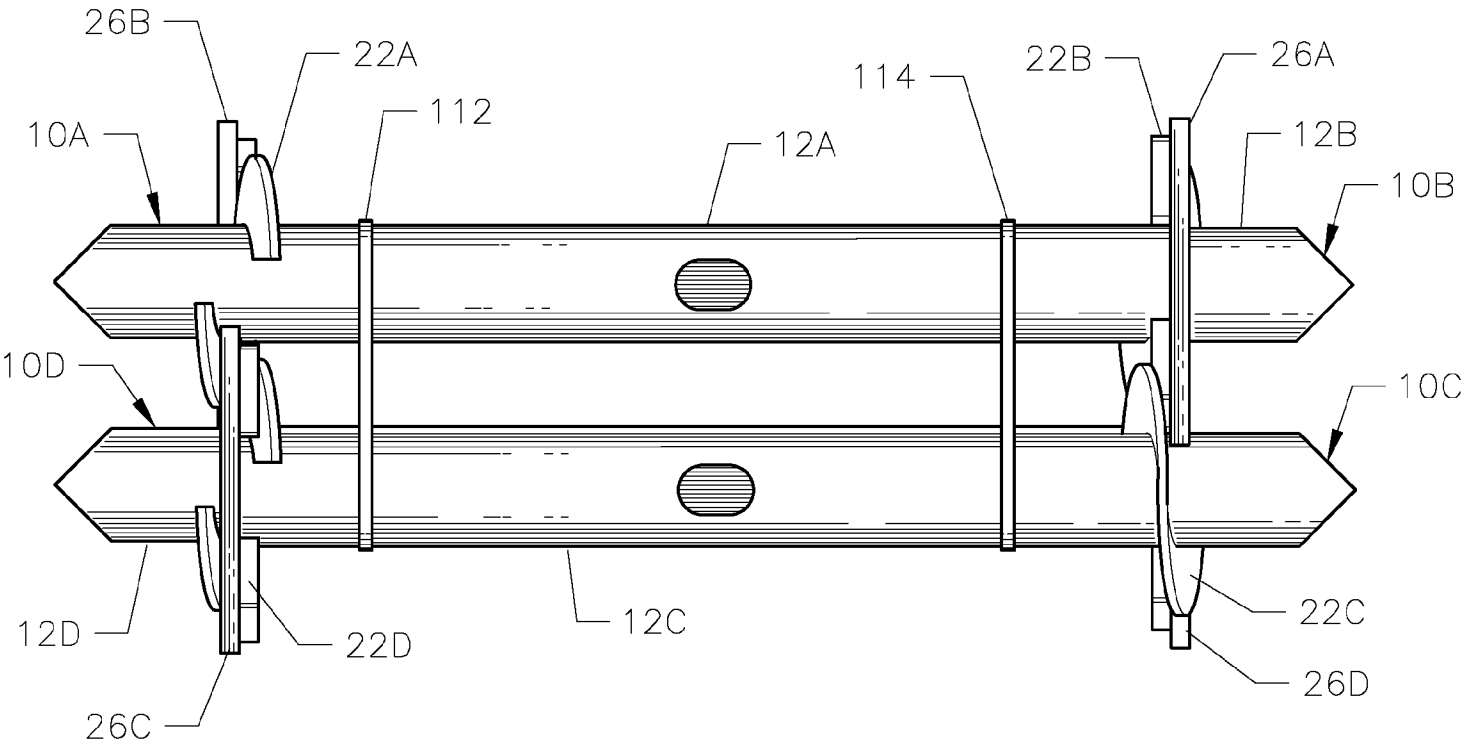
FIG. 12 shows a side elevational view of a bundle of four foundation anchors secured with metal bands securing the anchors in the stacked position.
Figure 13:
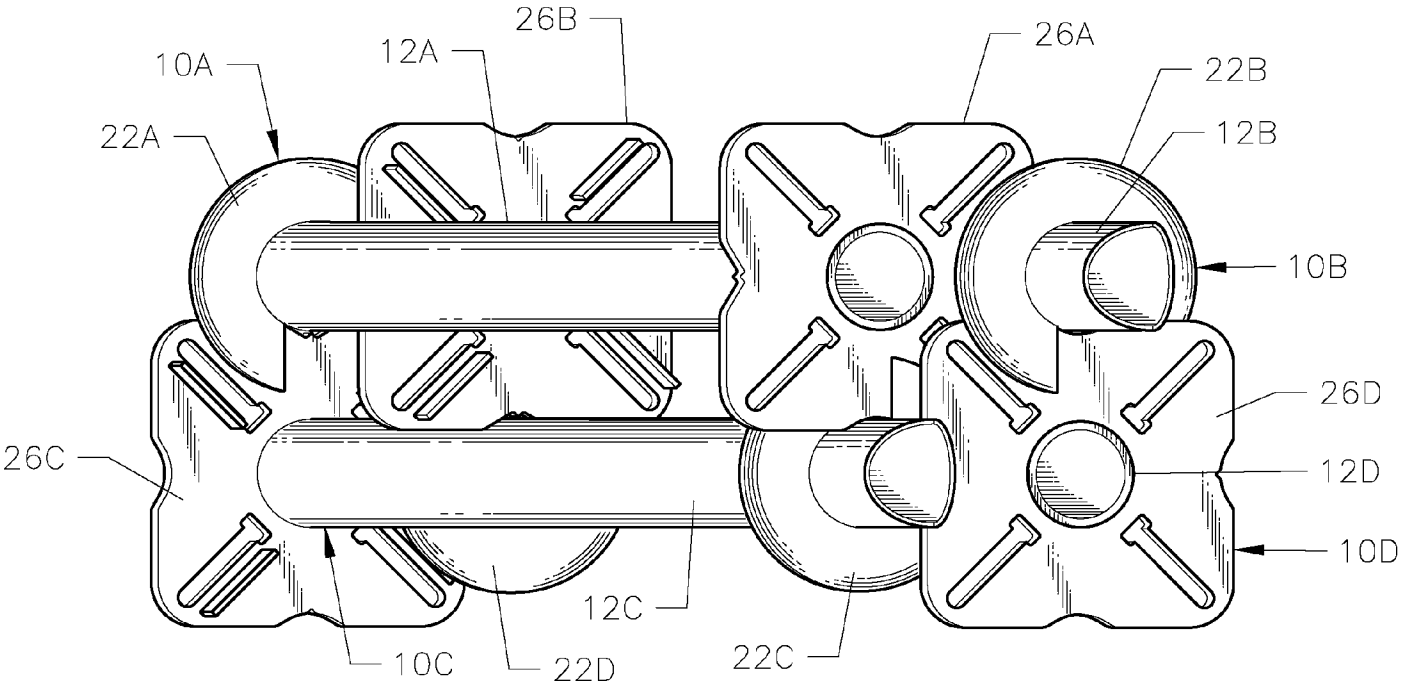
FIG. 13 shows an end perspective view of the bundle of anchors seen in FIG. 12. The bands have been removed to simplify the illustration.

Although, the number, size and shape of the notches 100, 102, 104 and 106 may vary, generally the notches are sized and shaped to engage a portion of the shaft of an adjacent anchor in the bundle, as seen in FIGS. 12 and 13, to which attention now is directed. In this preferred embodiment, four anchors 10A-10D are stacked together to form a single bundle 110 secured by at least one band and preferably a pair of bands 112 and 114. The bands 112 and 114 shown herein are flat, slender metal straps, such as commercial shipping straps or bands, which are secured end to end by strapping buckles (not shown). It will understood that the term "band," as used herein, denotes any structure or member capable of securing the assembly of multiple anchors together in the stacked position. Thus, the band may take the form of a wide swath of plastic, or single wide elastic belt of some sort.

To make the most compact and stable bundle, the anchors 10A-D are arranged so that the orientation of each anchor is opposite relative to the adjacent anchors engaged by the notches on its base plate. That is, the upper end of one anchor is adjacent the lower end of the anchor above, below, and to either side of it. In this way, as seen in FIG. 13 for example, one notch on the base plate 26A engages the shaft 12B of the anchor 10B above the blade 22B, while another notch engages the shaft 12C of the anchor 10C below the blade 22C. At the same time, a notch on the base plate 26B engages the shaft 12A of the anchor 10A above the blade 22A, and a notch on the base plate 26C of the anchor 10C engages the shaft 12A of the anchor 10A below the blade 22A. This alternating arrangement of the anchors provides a stable and balanced bundle.

Returning once again to FIG. 2, it may be desirable to include alignment means, such as the point 120 and the indentation 122, to indicate the sides of the shaft on which the conduit openings 24 are found. In a conventional manner, the indentation 122 may used to indicate the side for the incoming wiring, and the point 120 may be used to indicate the side for the outgoing wiring. The alignment point 120 and indentation 122 are conveniently placed in the center portion of a pair of opposing stacking notches, such as the notches 100 and 104.

Now it will be appreciated that the present invention provides many advantages. The notched base plate allows multiple anchors to be stacked in a bundle and secured with straps for stable transport. The slots in the base plate allow the bolt that connects the pole base to the base plate to be inserted from above. This makes installation of the pole easier and faster. Moreover, the spacers underneath the base plate excavate a sufficient amount of earth under the plate so that the head of the bolt can be easily manipulated into the proper location. This had the added advantage of minimizing the extent to which the soil surrounding the installation must be disturbed.

The embodiments shown and described herein are exemplary. Some elements or features of the present invention may be found in the art and, therefore, have not been described in detail herein. The description and drawings are illustrative only, and changes may be made in the combination and arrangement of the various parts and elements described herein without departing from the spirit and scope of the invention as defined in the following claims. The description and drawings do not point out what an infringement of this patent would be, but rather merely provide one example of how to use and make the invention. The limits of the invention and the bounds of the patent protection are measured by the claims.

What is claimed is:

1. A foundation anchor for implantation in compressible material such as earth, the anchor stackable with other like anchors to form a bundle of anchors for shipment, the anchor comprising:

a shaft having a body portion, an upper end and a lower end; and a planar base plate on the upper end of the shaft, the base plate having a peripheral edge, the peripheral edge defining a plurality of sides comprising at least three sides, wherein the base plate further includes a plurality of notches spaced equidistantly around the peripheral edge with one notch positioned in each of the at least three sides, each of the notches sized and shaped to engage a portion of the shaft of an adjacent like anchor in the bundle, whereby a plurality of like anchors are non-movably stackable together in multiple directions to form the bundle in a combination of rows and columns.

2. The foundation anchor of claim 1 further comprising a helical blade on the shaft shaped to facilitate insertion into the compressible.

3. The foundation anchor of claim 1 wherein the base plate is square having four straight sides.

4. The foundation anchor of claim 3 wherein the plurality of notches comprises four notches, one centered on each of the four-straight sides of the base plate sides whereby a plurality of at least four like anchors are non-movably stackable together in at least two rows and two columns to form the bundle.

5. The foundation anchor of claim 4 further comprising a helical blade on the shaft shaped to facilitate insertion into the compressible material and wherein the shaft is hollow.

6. The foundation anchor of claim 1 further comprising at least one connector comprising a head and a stem, the head being wider than the stem, and wherein the base plate defines at least one slot comprising a head portion and a stem portion, wherein the head portion is sized to allow passage therethrough of the head of the connector, and wherein the stem portion is sized to permit passage therethrough of the stem of the connector but not the head of the connector, whereby the connector can be positioned with the head of the connector under the base plate and the stem extending through the base plate by inserting the head of the connector through the slot from a position above the base plate when the base plate is about flush with the surface of the compressible material.

7. The foundation anchor of claim 6 wherein the connector comprises a nut and bolt, wherein the stem of the bolt is threaded, wherein the nut is threadedly receivable on the stem, wherein the head is polygonal having at least one planar side parallel to the longitudinal axis of the stem, wherein the base plate includes an abutment surface perpendicular to the base plate and adjacent the stem portion of the slot, whereby when the head of the connector is beneath the base plate and the stem extends up through the stem portion of the slot, the planar side of the head non-rotating engages the abutment surface so that the nut can be threadedly tightened on the stem.

8. The foundation anchor of claim 7 wherein the compressible material is soil, wherein the shaft comprises a helical blade on the body portion thereof so that the shaft is driven by rotation, and wherein the abutment surface is defined by an elongate member depending from the base plate and adapted to excavate an area of soil when the base plate rotatingly contacts the surface of the soil thereby providing a space in the soil to receive the head of the bolt.

9. The foundation anchor of claim 6 wherein the stem is threaded, wherein the connector comprises a nut threadedly receivable on the stem, wherein the head of the connector comprises a cap and a neck, the neck being between the cap and the stem, wherein the cap has a diameter greater than the stem portion of the slot, and wherein the neck is an equilateral polygon having at least two planar sides parallel to the longitudinal axis of the stem so that the neck is non-rotatingly engageable in the stem portion of the slot, whereby when the cap of the bolt head is beneath the base plate and the neck is non-rotatingly engaged in the stem portion of the slot with the stem of the bolt extending above the base plate, the nut can be threadedly tightened on the stem.

10. The foundation anchor of claim 9 wherein the compressible material is soil, wherein the shaft comprises a helical blade so that the shaft is driven by rotation, and wherein the abutment surface is defined by an elongate member depending from the base plate and adapted to excavate an area of soil when the base plate rotatingly contacts the surface of the soil thereby providing a space in the soil to receive the head of the bolt.

11. The foundation anchor of claim 10 wherein the bolt is a carriage bolt and wherein the neck of the head is square.

12. The foundation anchor of claim 6 wherein the base plate is square and comprises four slots, one in each corner, and wherein the assembly comprises four connectors, one for each slot.

13. The foundation anchor of claim 6 wherein the slot is T-shaped so that the head portion is at one end of the stem portion.

14. The foundation anchor of claim 13 wherein the stem portion of the slot extends radially from the center of the base plate and wherein the head portion of the slot is between the stem portion and the center of the base plate.

15. The foundation anchor of claim 1 wherein the shaft is hollow.

16. The foundation anchor of claim 1 wherein the compressible material is soil and wherein the anchor further comprises:

at least one connector comprising a head and a stem, the head being wider than the stem;

wherein the base plate defines at least one slot comprising a stem portion sized to permit passage therethrough of the stem of the connector but not the head of the connector; and a spacer depending from the base plate and adapted to excavate an area of soil beneath the slot when the base plate contacts the surface of the soil, thereby providing a space in the soil surface to receive the head of the connector when the base plate is embedded in the soil.

17. The foundation anchor of claim 16 wherein the connector comprises a nut and bolt, wherein the stem of the bolt is threaded, wherein the nut is threadedly receivable on the stem, wherein the head is polygonal having at least one planar side parallel to the longitudinal axis of the stem, and wherein the spacer on the base plate includes an abutment surface perpendicular to the base plate and adjacent the stem portion of the slot, whereby when the head of the connector is beneath the base plate and the stem extends up through the stem portion of the slot, the planar side of the head non-rotating engages the abutment surface so that the nut can be threadedly tightened on the stem.

18. The foundation anchor of claim 16 wherein the stem of the connector is threaded, wherein the connector comprises a nut threadedly receivable on the stem, wherein the head of the connector comprises a cap and a neck, the neck being between the cap and the stem, wherein the cap has a diameter greater than the stem portion of the slot, and wherein the neck is an equilateral polygon having at least two planar sides parallel to the longitudinal axis of the stem so that the neck is non-rotatingly engageable in the stem portion of the slot, whereby when the cap of the bolt head is beneath the base plate and the neck is non-rotatingly engaged in the stem portion of the slot with the stem of the bolt extending above the base plate, the nut can be threadedly tightened on the stem.

19. The foundation anchor of claim 18 wherein the bolt is a carriage bolt and wherein the neck of the head is square.

20. The foundation anchor of claim 16 wherein the base plate is square and comprises four slots, one in each corner, and wherein the anchor comprises four connectors, one for each slot, and wherein the anchor further comprises four spacers one for each slot.

21. The foundation anchor of claim 16 wherein the slot is T-shaped so that the head portion is at one end of the stem portion.

22. The foundation anchor of claim 21 wherein the stem portion of the slot extends radially from the center of the base plate and wherein the head portion of the slot is between the stem portion and the center of the base plate.

23. The foundation anchor of claim 16 wherein the stem portion of the slot extends radially from the center of the base plate and wherein the head portion of the slot is between the stem portion and the center of the base plate.

24. The foundation anchor of claim 16 further comprising a helical blade on the shaft whereby the shaft can be driven by rotation into the compressible material, and wherein the spacer is adapted to excavate the compressible material under the base plate as the base plate rotatingly engages the compressible material.

25. A bundle of foundation anchors comprising:

a plurality of foundation anchors, each such anchor designed for implantation in compressible material such as earth, each anchor comprising:

a shaft having a body portion, an upper end and a lower end; and a planar base plate on the upper end of the shaft, the base plate having a peripheral edge, the peripheral edge defining a plurality of sides comprising at least three sides, wherein the base plate further includes a plurality of notches spaced equidistantly around the peripheral edge with one notch positioned in each of the at least three sides, each of the notches sized and shaped to engage a portion of the shaft of an adjacent like anchor in the bundle;

wherein the plurality of anchors are stacked together so that one of the notches in the base of each anchor engages the shaft of another one of the plurality of anchors;

wherein the plurality of anchors comprises at least three anchors and wherein the three anchors are stacked in multiple directions to form the bundle in a combination of rows and columns; and at least one band sized and positioned to secure the plurality of anchors in the stacked position.

26. The bundle of foundation anchors of claim 25 wherein the plurality of anchors comprises four anchors.

27. The bundle of foundation anchors of claim 25 wherein the at least one band comprises two bands, each one encircling the bundle around the body portions of the shafts.

28. The bundle of foundation anchors of claim 25 wherein each of the anchors comprises a helical blade on the shaft shaped to facilitate insertion into the compressible material.

29. The bundle of foundation anchors of claim 25 wherein the base plate on each of the anchors is square having four straight sides.

30. The bundle of foundation anchors of claim 29 wherein the plurality of notches comprises four notches, one centered on each of the four straight sides of the base plate.

31. The bundle of foundation anchors of claim 30 wherein the plurality of foundation anchors comprises at least four anchors and the anchors are stacked in two rows and two columns.

32. The bundle of foundation anchors of claim 25 wherein the plurality of foundation anchors comprises at least four anchors and the anchors are stacked in at least two rows and at least two columns.

* * * * *

UNITED STATES PATENT AND TRADEMARK OFFICE

CERTIFICATE OF CORRECTION

PATENT NO. : 8,875,451 B1
APPLICATION NO. : 11/669276
DATED : November 4, 2014
INVENTOR(S) : A. Phillip Parduhn et al.

It is certified that error appears in the above-identified patent and that said Letters Patent is hereby corrected as shown below:

In the Specification

Column 1, line 19: replace “number anchors” with --number of anchors--.
Column 4, line 20: replace “could a carriage” with --could be a carriage--.
Column 4, line 30: replace “in stem” with --in the stem--.
Column 4, line 48: replace “appreciated further that” with --appreciated that--.
Column 5, line 13: replace “holes” with --hole--.
Column 5, line 44: replace “in center” with --in the center--.
Column 5, line 63: replace “will understood” with --will be understood--.
Column 6, line 20: replace “may used” with --may be used--.
Column 6, line 34: replace “had” with --has--.

In the Claims

Column 8, line 67: replace “spacers” with --spacers,--.

Signed and Sealed this
Twenty-fourth Day of February, 2015

Michelle K. Lee

Michelle K. Lee
*Deputy Director of the United States Patent and Trademark Office*